US007296307B2

(12) United States Patent
Atwater et al.

(10) Patent No.: US 7,296,307 B2
(45) Date of Patent: Nov. 20, 2007

(54) ATHLETIC PROTECTOR CONVERTIBLE FROM HARD-CUP TO SOFT-CUP CONFIGURATION

(75) Inventors: Mark V. Atwater, Yanceyville, NC (US); William D. Atwater, Yanceyville, NC (US); Charles R. Edwards, Siler City, NC (US)

(73) Assignee: Royal Textile Mills, Inc., Yanceyville, NC (US)

( * ) Notice: Subject to any disclaimer, the term of this patent is extended or adjusted under 35 U.S.C. 154(b) by 370 days.

(21) Appl. No.: 10/832,569

(22) Filed: Apr. 27, 2004

(65) Prior Publication Data

US 2005/0278839 A1 Dec. 22, 2005

(51) Int. Cl.
*A41D 27/12* (2006.01)

(52) U.S. Cl. ..... 2/466; 2/23; 2/400; 2/403; 2/404; 2/406; 2/407; 128/846; 128/891; 602/67; 602/70; 602/71; 602/72

(58) Field of Classification Search ..... 2/23, 2/400, 403, 404, 406, 407, 466; 128/846, 128/891; 602/67, 70, 71, 72
See application file for complete search history.

(56) References Cited

U.S. PATENT DOCUMENTS

| | | | | |
|---|---|---|---|---|
| 3,176,686 | A * | 4/1965 | Barnes | 128/846 |
| 4,641,641 | A | 2/1987 | Strock | |
| 4,922,899 | A * | 5/1990 | Graff et al. | 602/72 |
| 5,020,547 | A | 6/1991 | Strock | |
| 5,557,804 | A | 9/1996 | Ovortrup et al. | |
| 6,048,327 | A | 4/2000 | Kieffer | |
| 6,319,219 | B1 | 11/2001 | Landi | |
| 2003/0163076 | A1 | 8/2003 | Lukens | |
| 2004/0024341 | A1 | 2/2004 | Jacobs | |

* cited by examiner

*Primary Examiner*—Gary L. Welch
*Assistant Examiner*—Alissa J Tompkins
(74) *Attorney, Agent, or Firm*—Alston & Bird LLP

(57) ABSTRACT

An athletic cup that is convertible from a hard cup configuration to a soft cup configuration. The hard cup configuration can be used for contact sports or ball sports where maximum protection is needed. The cup can be converted to the soft cup configuration for non-contact sports where a lesser degree of protection is adequate. The cup comprises a hard cup and a soft cup that are detachably connected to each other to form the hard cup configuration. To convert to the soft cup configuration, the hard cup is detached and the soft cup is worn by itself.

11 Claims, 2 Drawing Sheets

ATHLETIC PROTECTOR CONVERTIBLE FROM HARD-CUP TO SOFT-CUP CONFIGURATION

BACKGROUND OF THE INVENTION

The present invention relates to athletic protectors for protecting the genitals.

Athletic protectors for protecting the genitals during sporting activities generally fall into either the "hard cup" or the "soft cup" type. Hard cups are typically worn for contact sports or those involving high-speed projectiles (e.g., baseball, hockey, lacrosse, etc.), where there is a significant likelihood of being struck in the groin with a hard blow. The traditional type of hard cup includes a rigid plastic shell bonded to a softer material that forms a margin or edge region of the cup for contacting the wearer's body during use. Such hard cups are not particularly comfortable to wear.

Soft cups are much more pliable than hard cups, and are usually worn in non-contact sports or activities that do not involve a significant likelihood of receiving a hard, high-velocity blow to the groin. A soft cup offers more protection than a jock strap alone, but not nearly as much as a hard cup. The chief advantage of the soft cup is that it is much more comfortable to wear than a hard cup.

A particular individual who is involved in both contact sports and non-contact sports generally would have to own at least one hard cup and at least one soft cup.

BRIEF SUMMARY OF THE INVENTION

The present invention provides an athletic cup that is convertible from a hard cup configuration to a soft cup configuration. The hard cup configuration can be used for contact sports or ball sports where maximum protection is needed. The cup can be converted to the soft cup configuration for non-contact sports where a lesser degree of protection is adequate.

Toward these ends, the cup comprises a hard cup and a soft cup that are detachably connected to each other to form the hard cup configuration. To convert to the soft cup configuration, the hard cup is detached and the soft cup is worn by itself.

The soft cup is a relatively soft and resilient, molded one-piece structure having a domed central portion and a peripheral edge portion extending about a periphery of the domed central portion. The hard cup is relatively rigid and has a domed shape complementary to that of the domed central portion of the soft cup. The soft cup and hard cup respectively define interlocking male and female connecting members that are removably engageable with one another for affixing the hard cup to the soft cup in a releasable manner.

In one embodiment of the invention, the soft cup includes opposed grooves at opposed regions of the peripheral edge portion, at the convex (outer) side of the soft cup, with the opposed grooves having their open sides facing generally toward a center of the domed central portion of the soft cup. Opposite edges of the hard cup are engaged in the opposed grooves to secure the two cups together with the hard cup overlying the outer side of the domed central portion of the soft cup. The edges of the hard cup can define beads and the grooves in the soft cup can be complementary in shape to receive the beads in a snap-fit fashion. The soft cup can be flexed to disengage the hard cup edges from the grooves so as to detach the hard cup. The grooves in the soft cup thus comprise female connecting members and the edges of the hard cup comprise male connecting members. Other configurations of male and female connecting members could be used instead of the edges and grooves described above.

In one embodiment of the invention, the hard cup has opposite side edges extending between the top and bottom edge portions, and the soft cup defines a pair of shoulders respectively abutted by the opposite side edges of the hard cup such that impact forces on the hard cup are transmitted in part to the shoulders of the soft cup.

Advantageously, the side edges of the hard cup have portions that are recessed inwardly of the opposite side edges of the soft cup. The recessed portions help avoid interference with the wearer's thighs that might otherwise occur if the recessed portions were not provided.

The soft cup can include ventilation apertures. The hard cup can include ventilation holes that are aligned with the ventilation apertures in the soft cup.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
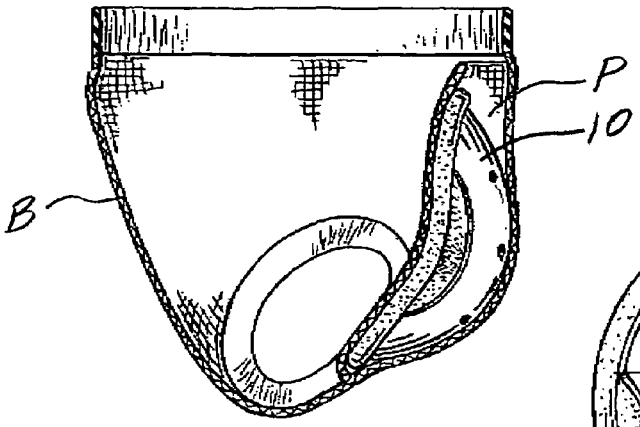
FIG. 1 is a sectioned side view of a brief having a pocket in which an athletic protector in accordance with one embodiment of the invention is held.
Figure 2:
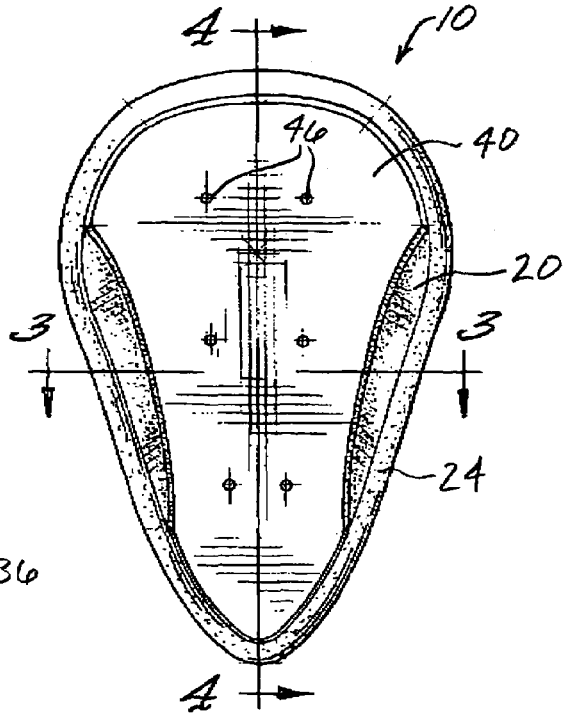
FIG. 2 is a front elevation of the athletic protector.
Figure 3:
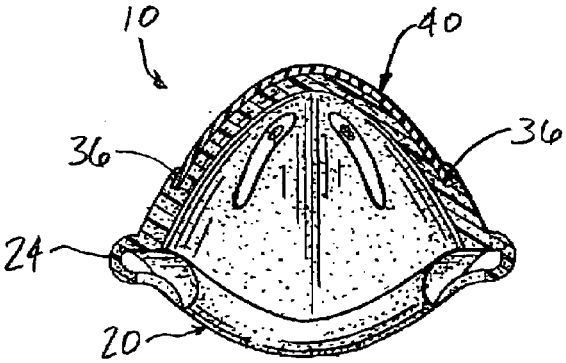
FIG. 3 is a cross-sectional view taken along line 3-3 in FIG. 2.
Figure 4:
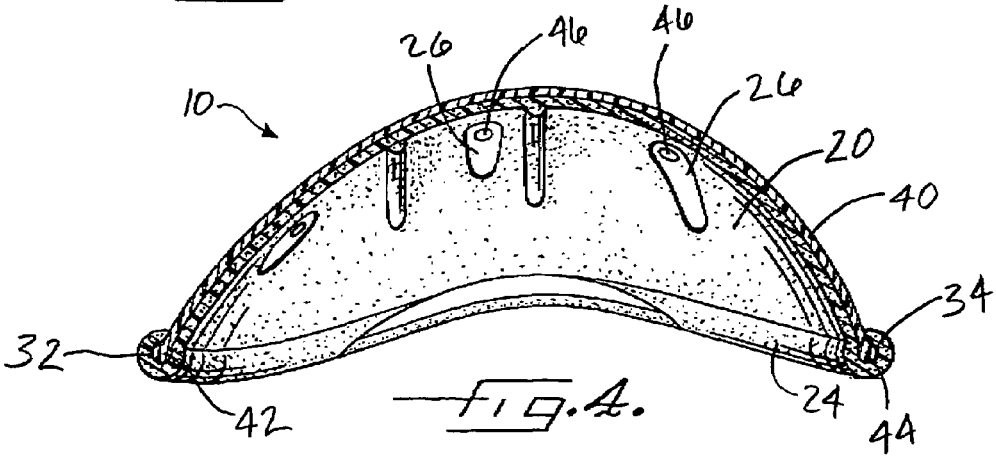
FIG. 4 is a cross-sectional view taken along line 4-4 in FIG. 2.
Figure 5:
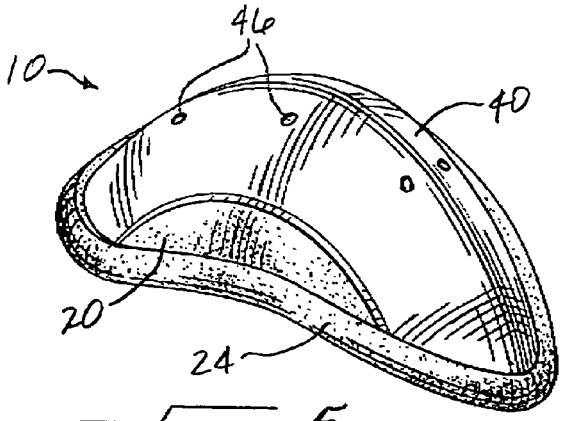
FIG. 5 is a perspective view of the athletic protector in the hard-cup configuration.
Figure 6:
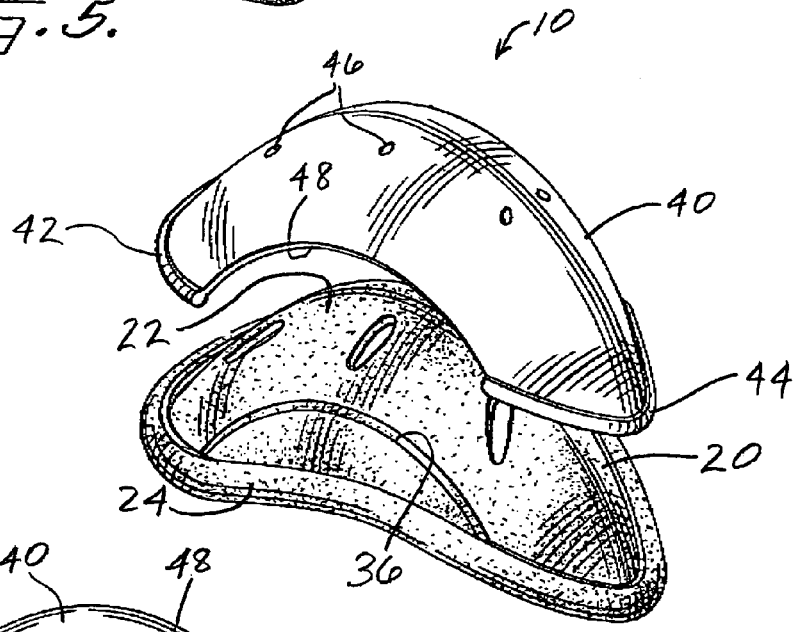
FIG. 6 is an exploded perspective view of the athletic protector, generally from above, showing the hard cup detached from the soft cup to convert to the soft-cup configuration.
Figure 7:
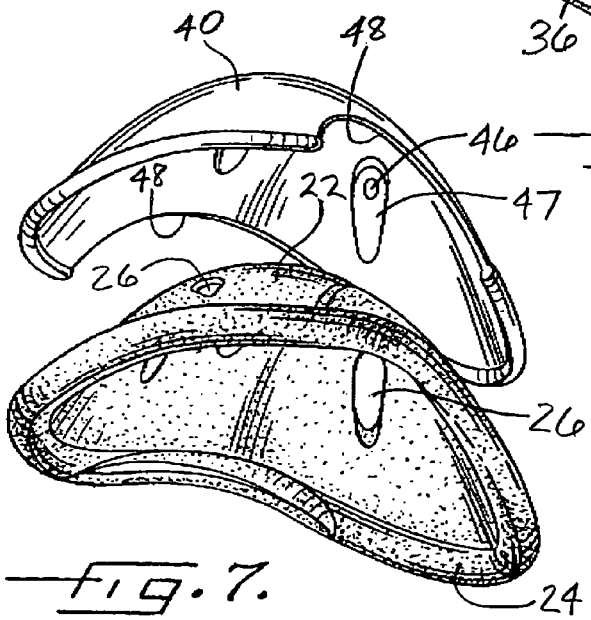
FIG. 7 is an exploded perspective view of the athletic protector generally from below.

FIG. 1 depicts an athletic protector 10 in accordance with one embodiment of the invention retained within a pocket P of a brief B, which functions to hold the protector in its proper position during activity. Alternatively, the protector could be used with a conventional jock strap or the like.

FIGS. 2-7 depict the athletic protector 10 in further detail. The athletic protector 10 includes a soft cup 20 of relatively soft, resiliently flexible material, and a hard cup 40 of relatively hard, rigid material. The soft cup and hard cup are detachably connected. The soft cup has a generally cup-shaped or domed central portion 22 and a peripheral edge portion 24 extending along the outer periphery of the domed central portion. The soft cup 20 in plan view or front elevation (FIG. 2) has a rounded triangular shape, being wider at its upper end than at its lower end. In use, the lower end of the soft cup is proximate the perineal region of the body and the upper end of the soft cup is proximate the pubic arch. The peripheral edge portion 24 is relatively thick and wide where it lies against the body so that impact forces on the athletic protector are distributed over a relatively large area of the body. The soft cup includes ventilation apertures 26 in the domed central portion.

The hard cup 40 has a domed shape complementary to that of the domed central portion 22 of the soft cup. The hard cup in plan view also has a generally triangular shape, being wider at its top end than at its bottom end. Along a top edge of the hard cup is a rim or bead 42 of greater thickness than the adjoining domed region of the hard cup. Similarly, along a bottom edge of the hard cup is a thickened rim or bead 44. The hard cup includes ventilation holes 46 positioned so they are aligned with the ventilation apertures 26 in the soft cup when the hard cup is connected to the soft cup. Each hole 46 can be surrounded by a raised boss 47 shaped to fit closely into a corresponding ventilation aperture 26 of the soft cup. The bosses 47 thus help to hold the hard cup in proper alignment with the soft cup and add lateral integrity to the assembly of the hard cup and soft cup.

The connection of the hard cup 40 to the soft cup 20 will now be described. The soft cup 20 defines a groove 32 in its outward-facing surface (i.e., the surface that faces away from the wearer's body) at a location proximate the juncture between the domed central portion 22 and the peripheral edge portion 24 along the upper edge of the soft cup. The soft cup also defines a groove 34 in its outward-facing surface proximate the juncture between the domed central portion and the peripheral edge portion along the lower edge of the soft cup. The grooves 32, 34 have their open sides facing generally toward a center of the domed central portion of the soft cup. The grooves 32, 34 are shaped in cross-section in complementary fashion to the cross-sectional shapes of the beads 42, 44 along the top and bottom edges of the hard cup 40. In particular, the grooves have a keyhole type shape with a wide part and a narrow part. The wide parts of the grooves receive the relatively thicker beads on the hard cup, but the beads must first pass through the narrow parts of the grooves. In this manner, the beads 42, 44 on the hard cup fit into the grooves 32, 34 of the soft cup in a snap-fit fashion. The material of the soft cup is resiliently flexible to permit the beads to be inserted into the grooves. The beads fit into the grooves in a close-fitting manner so that they tend to resist being pulled back out of the grooves. However, when it is desired to detach the hard cup from the soft cup, the flexible material of the soft cup allows enough deformation to permit the beads to be pulled out of the grooves with a reasonable amount of force.

The soft cup 20 can be molded of various polymer materials such as the class of materials referred to as thermoplastic elastomers. For instance, the soft cup can comprise polyethylene, polyurethane, polypropylene, or ethylene vinyl acetate. A suitable material, for example, is product number 5403-80A from Technical Polymers LLC of Lawrenceville, Ga. The polymer molding composition can include a chemical or physical foaming agent so that the composition foams to form a multitude of air cells in the finished product. Advantageously, the soft cup material has a durometer hardness of about 70-90, preferably about 80, on the Shore A scale.

The hard cup 40 can be molded of various polymer materials that have substantial rigidity. Such materials include but are not limited to polycarbonate, acrylonitrile-butadiene-styrene (ABS), polyethylene, polypropylene, and blends thereof. A preferred material is polypropylene copolymer, such as product number TI-6120-NB available from Sunoco Chemicals, Polymers Division, of Philadelphia, Pa.

To improve the comfort of wearing the athletic protector 10 in the hard cup configuration, the hard cup 40 advantageously has opposite side edges 48 that are recessed inwardly of the corresponding side edges of the soft cup. The recessed side edges 48 lessen the interference between the hard cup 40 and the wearer's thighs that can occur in certain body positions. Advantageously, the soft cup 20 includes shoulders or grooves, comprising engagement members 36, that are abutted or engaged by the recessed side edges 48 of the hard cup. The engagement members 36 help hold the hard cup and soft cup together and also absorb force from the hard cup when the athletic protector is struck, so that the impact force is transmitted to the soft cup along the entire periphery of the hard cup rather than only along the upper and lower edges of the hard cup.

The athletic protector 10 is usable in either a hard cup configuration or a soft cup configuration. In the hard cup configuration, the hard cup 40 is attached to the soft cup 20 by snapping the beads 42 and 44 on the edges of the hard cup into the grooves 32 and 34 in the soft cup. The athletic protector can then be inserted into a jock strap, brief, or other supporting garment that aids in retaining the protector in proper position during wear.

To use the protector 10 in the soft cup configuration, the hard cup 40 is detached from the soft cup 20, and only the soft cup is inserted into the supporting garment such as the brief B shown in FIG. 1.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A dual-usage athletic protector for protecting the genitals, the dual-usage athletic protector being selectively usable in either a hard-cup configuration or a soft-cup configuration, and comprising:

an outer relatively rigid hard cup and an inner relatively soft and resilient soft cup;

the soft cup molded as a one-piece structure of rounded triangular shape in plan view and having a domed central portion and a peripheral edge portion extending about a periphery of the domed central portion, the domed central portion having a convex outer surface such that the soft cup is configured for being worn by itself in the soft-cup configuration to protect a user's genitals during activities in which hard-cup protection is not required; and the hard cup having a domed shape complementary to that of the domed central portion of the soft cup, the hard cup having a concave inner surface for placement against the outer surface of the soft cup when the hard cup is assembled with the soft cup in the hard-cup configuration, the soft cup covering the entire inner surface of the hard cup in the hard-cup configuration;

wherein the peripheral edge portion of the soft cup forms grooves into which outer peripheral edge portions of the hard cup are removably insertable for affixing the hard cup to the soft cup in a releasable manner enabling the athletic protector to be convertible between the hard-cup and soft-cup configurations.

2. The athletic protector of claim 1, wherein the outer peripheral edge portions of the hard cup define beads and the grooves in the soft cup are complementary in shape to the beads.

3. The athletic protector of claim 2, wherein the hard cup has a top edge portion defining one of the beads and a bottom edge portion defining another of the beads.

4. The athletic protector of claim 3, wherein the hard cup has opposite side edges extending between the top and bottom edge portions, and wherein the soft cup defines a pair of engagement members respectively engaged by the opposite side edges of the hard cup such that impact forces on the hard cup are transmitted in part to the engagement members of the soft cup.

5. The athletic protector of claim 1, wherein the soft cup defines ventilation apertures, and the hard cup defines ventilation holes in alignment with the ventilation apertures of the soft cup.

6. The athletic protector of claim 5, wherein each ventilation hole in the hard cup is surrounded by a raised boss shaped to fit closely into a corresponding ventilation aperture in the soft cup.

7. The athletic protector of claim 1, wherein the soft cup comprises thermoplastic elastomer.

8. The athletic protector of claim 7, wherein the soft cup comprises polymer foam having a durometer hardness of about 70 to 90 Shore A.

9. The athletic protector of claim 1, wherein the hard cup comprises a material selected from the group consisting of polycarbonate, acrylonitrile-butadiene-styrene, polyethylene, polypropylene, and blends thereof.

10. The athletic protector of claim 9, wherein the hard cup comprises polypropylene copolymer.

11. The athletic protector of claim 1, wherein the hard cup has opposite side edges each of which defines a recessed portion spaced inwardly from a respective side edge of the soft cup for lessening interference between the hard cup and a wearer's thighs.

* * * * *